US005478302A

United States Patent [19]

Bluemle

[11] Patent Number: 5,478,302

[45] Date of Patent: Dec. 26, 1995

[54] METHOD FOR CONTINUOUSLY PRODUCING ENVELOPES, BAGS, AND SHIPPING POUCHES AND THE PRODUCT SO PRODUCED

[75] Inventor: Martin Bluemle, Horhausen, Germany

[73] Assignee: Winkler & Duennebier Maschinenfabrik und Eisengiesserei KG, Neuwied, Germany

[21] Appl. No.: 427,893

[22] Filed: Apr. 26, 1995

Related U.S. Application Data

[63] Continuation of Ser. No. 240,540, May 10, 1994, abandoned, which is a continuation of Ser. No. 839,108, Feb. 20, 1992, abandoned.

[30] Foreign Application Priority Data

Feb. 20, 1991 [DE] Germany ..... 41 05 140.8

[51] Int. Cl.[6] ..... B31B 23/60

[52] U.S. Cl. ..... 493/235; 493/263; 493/264

[58] Field of Search ..... 493/227, 228, 493/229, 230, 231, 232, 235, 236, 243, 255, 261, 262, 263, 264, 233, 244, 245

[56] References Cited

U.S. PATENT DOCUMENTS

| | | | |
|---|---|---|---|
| 543,571 | 7/1895 | Crist | 493/232 |
| 971,780 | 10/1910 | Parrish | 493/231 |
| 1,029,784 | 6/1912 | Appel . | |
| 2,012,357 | 8/1935 | Shea | 493/235 |
| 2,153,848 | 4/1939 | Shea | 493/232 |

FOREIGN PATENT DOCUMENTS

| | | |
|---|---|---|
| 421009 | 11/1925 | Germany . |
| 3145966 | 6/1983 | Germany . |
| 3145966 | 3/1985 | Germany . |

*Primary Examiner*—Jack W. Lavinder
*Attorney, Agent, or Firm*—W. G. Fasse; W. F. Fasse

[57] ABSTRACT

The invention relates to a method for the continuous manufacture of envelopes, bags, shipping pouches, or the like, of web type material, especially paper or the like, with or without side folds, including lateral gumming or central gumming and with a respective folded and glued bed bottom, whereby the web type material is first precreased, cut, provided with adhesive or gummed, folded, severed, prefabricated into a tubular blank, and finally closed at its bottom. The gist of the invention comprises:

a) that the steps for forming the bottom take place during a continuous feed advance, and b) that the material serving for the formation of the lower bottom flap (42) is displaced backwardly opposite to the transport direction in a zig-zag fold during the bottom formation, c) whereby bottom side tongues (10, 11) lay themselves laterally outwardly in the case of an envelope, a bag, or a shipping pouch, with side folds (63, 64), and d) whereby said bottom side tongues lay themselves over inwardly in case of an envelope, a bag, or a shipping pouch without side folds.

14 Claims, 16 Drawing Sheets

METHOD FOR CONTINUOUSLY PRODUCING ENVELOPES, BAGS, AND SHIPPING POUCHES AND THE PRODUCT SO PRODUCED

This application is a File-Wrapper Continuation of application Ser. No. 08/240,540 filed on May 10, 1994 now abandoned which in turn is a FWC of U.S. Ser. No. 07/839,108, filed Feb. 20, 1992, now abandoned.

FIELD OF THE INVENTION

The invention relates to a method for continuously producing of envelopes, bags, or shipping pouches of sheet material, especially of paper or the like with or without side folds, and with a side gumming or with a central gumming. The product has a folded or glued bed bottom, whereby the sheet material is first creased, cut, gummed, folded, severed, preformed into a tubular blank, and finally closed at its bottom side.

BACKGROUND INFORMATION

Methods of the type mentioned are known in different variants. The known methods provide products that slightly differ from one another. The invention has for its object to provide a method by means of which directly different types of envelopes, bags, or shipping pouches can be produced on the same machine, whereby such production shall take place as simply as possible and with the least troubles.

SUMMARY OF THE INVENTION

The invention provides the following features for achieving this objective. The steps for forming the bottom take place during a continuous longitudinal feed advance. The material required for the formation of the lower bottom flap is displaced back with a zig-zag fold opposite to the transport direction, whereby bottom side tongues are formed. In the case of an envelope, a bag, or a shipping pouch having side folds, the bottom side tongues lay themselves laterally outwardly. In case of an envelope, a bag, or a shipping pouch without side folds, the tongues lay themselves over inwardly.

The use of a zig-zag fold in the zone of the lower bottom flap, constitutes in connection with a continuous longitudinal feed advance, the basis for a manufacturing process which otherwise is variable in many ways, and thus capable for the production of different products on one and the same machine. It is, however, to be understood, that if necessary, minor machine technical adaptations may be required. However, basically, the zig-zag steps according to the invention for the bottom formation open up new possibilities for the production of envelopes, bags, and shipping pouches.

Further features of the invention are disclosed in the dependent claims in connection with the specification and the drawings.

BRIEF DESCRIPTION OF THE DRAWINGS

The invention will be described in more detail in the following with reference to example embodiments shown in the drawing, wherein.

Figure 1:
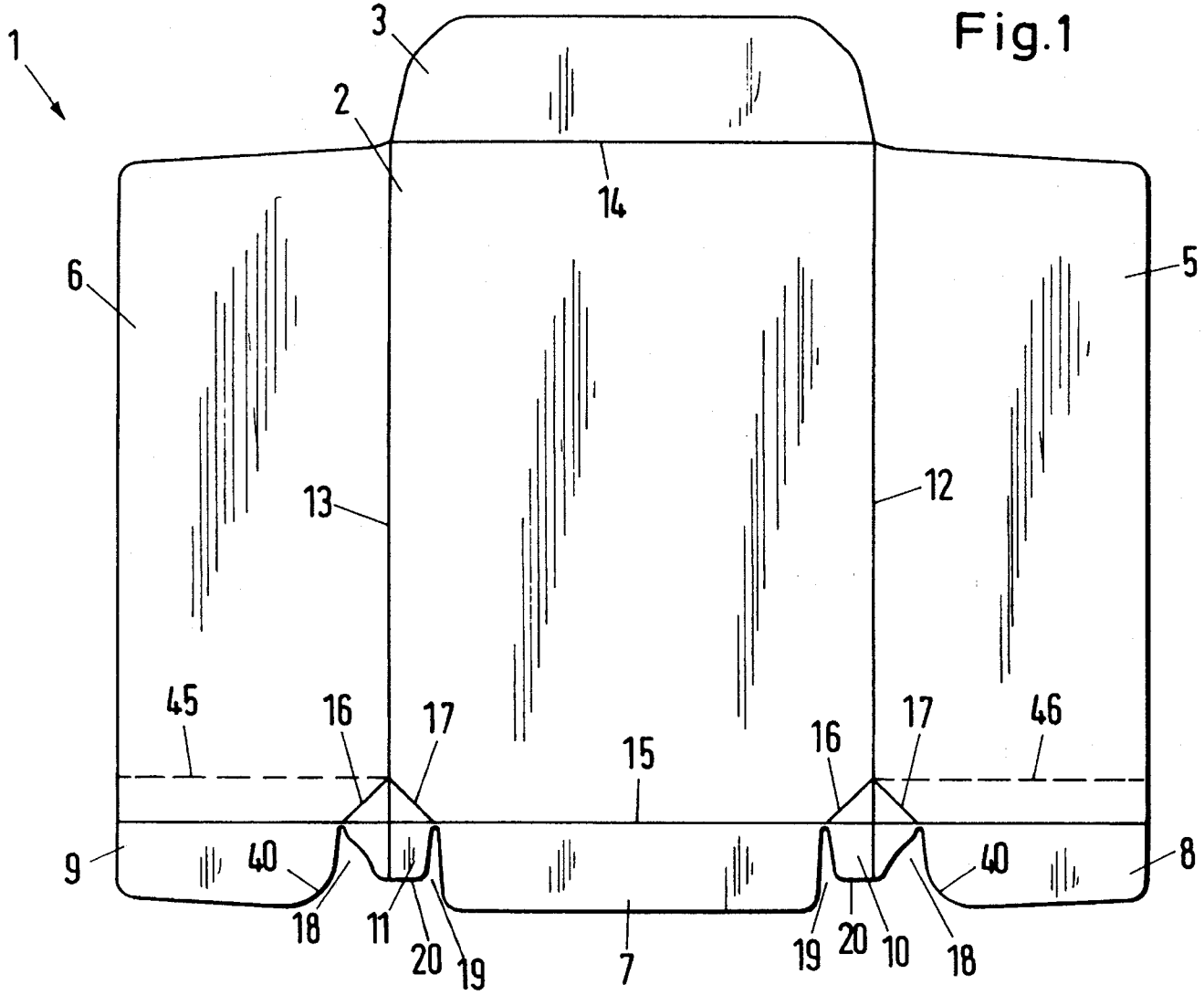
FIG. 1 is a developed view of a cut blank of a first product.

DETAILED DESCRIPTION OF PREFERRED EXAMPLE EMBODIMENTS AND OF THE BEST MODE OF THE INVENTION

The terms envelope, bag, or shipping pouch of paper will be referred to in the following text as product. A cut blank having a central gumming, comprises a front portion 2 with a closure flap 3 and two side or rather back flaps 5, 6 forming a back portion 4, and a first bottom flap 7, as well as a right and a left bottom flap half 8 and 9, and a respective right and left bottom side tongue 10 and 11. During the production the two bottom flap halves 8 and 9 according to FIG. 10 (method steps I and K) form together an inwardly lying, second bottom flap 42.

Further, precreases are provided, namely a respective right and left side flap longitudinal precrease 12 and 13 which also extend into the bottom side tongues 10, 11, and a cross precrease 14 for the closure flap 3, as well as a bottom flap cross precrease 15 by means of which the bottom side tongues 10 and 11 are bounded. Further, in the zone of the bottom side tongues 10 and 11, angular precreases 16 and 17 are provided which extend from the side flap longitudinal precreases 12, 13 toward double cuts in the form of outer and inner incisions or cuts 18 and 19 which bound the bottom side tongues 10 and 11. In a cut blank 1 for a product without side folds, the bottom side tongues 10 and 11 preferably taper nonsymmetrically toward their free ends 20. Thus, the outer incisions or cuts 18 in the outer zone are wider than the inner incisions or cuts 19 of said double cuts. Stated differently, the bottom side tongues 10 and 11 taper more strongly on the side of the bottom flap halves 8 and 9 than on the side facing toward the first bottom flap 7.

Figure 2:
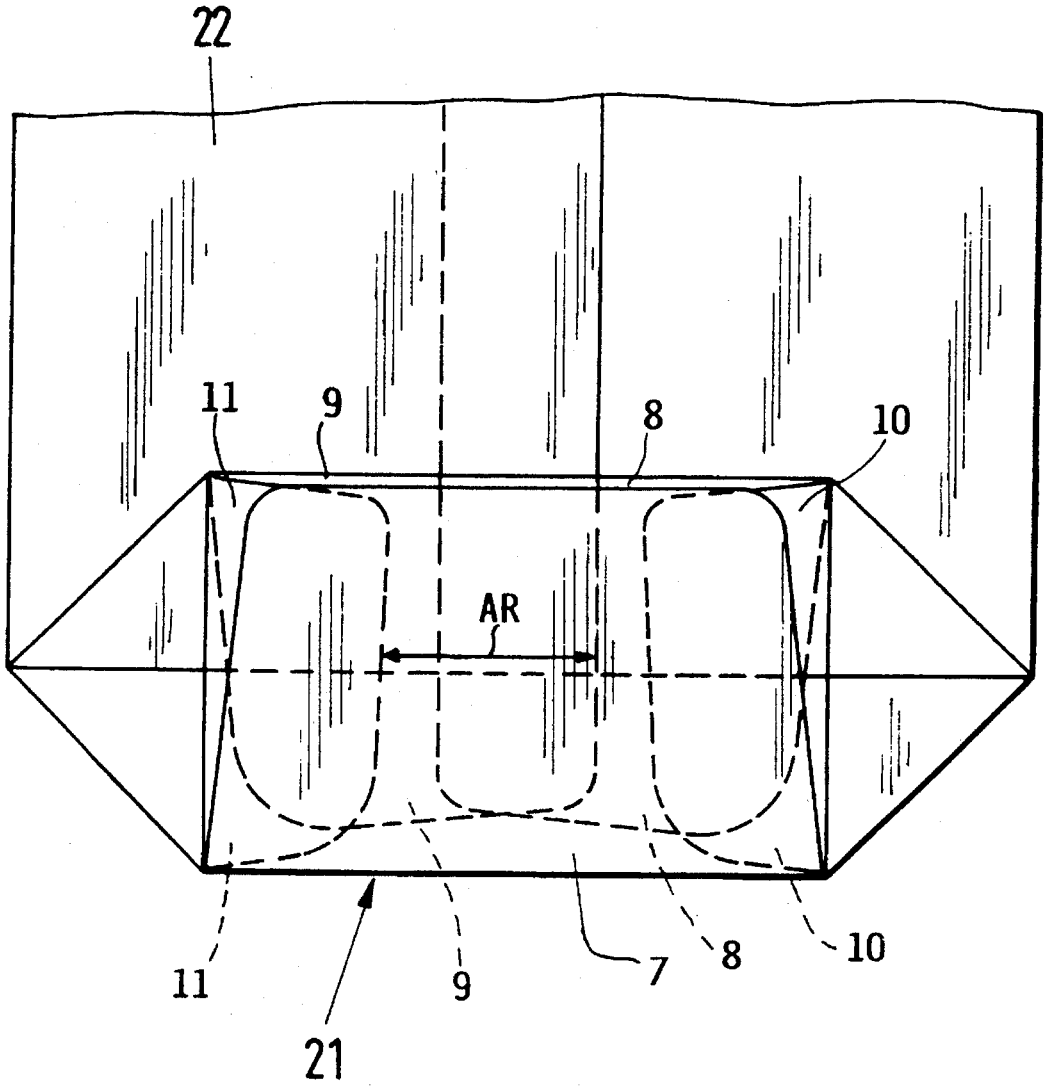
FIG. 2 shows, on an enlarged scale, a partial view of a slightly modified product with the view direction extending toward a flipped over bed bottom.

Further, according to a preferred embodiment the bottom side tongues 10 and 11 are shorter in the direction of the longitudinal precreases 12, 13 than the bottom flap and shorter than the bottom flap halves 8 and 9 forming the second bottom flap. This feature makes sure that in connection with extremely wide and simultaneously relatively short bed bottoms 21 in the product 22 shown in FIG. 2, no zone is formed in the bottom 21 where more than three material plies are overlapping one another. FIG. 2 shows that the bottom side tongues 10 and 11 are tucked in between the first bottom flap 7 and the bottom flap halves 8 and 9 that together form the second bottom flap 42. In the area between the side tongues 10 and 11 indicated by the double arrow AR the bottom flap 7 and the bottom flap halves 8, 9 contact each other directly.

Figure 3:
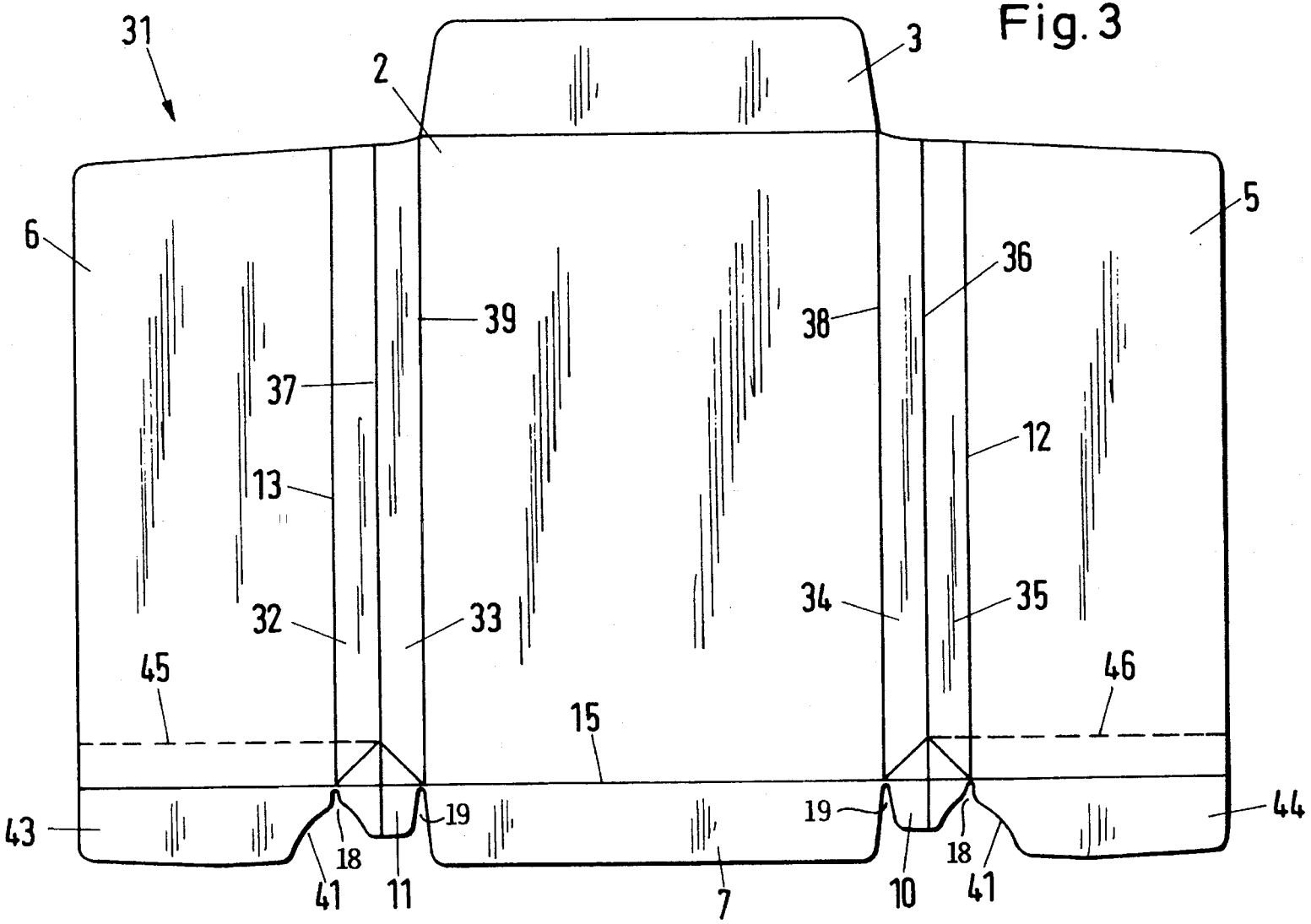
FIG. 3 is a developed view of a cut blank of a further product.

FIG. 3 shows a cut blank 31 for a modified product having side folds. The cut blank 31 thus comprises all the individual features of the cut blank 1 according to FIG. 1, whereby identical elements are provided with the identical same reference numbers.

Due to the side folds, the cut blank 31 comprises between the front portion 2 and each side flap 5 and 6, two each side portions 32 and 33 as well as 34 and 35 which form the side folds. Further, in addition to a right-hand side flap longitudinal precrease 12 and a left-hand side flap longitudinal precrease 13, there are provided, one each, a right-hand side fold longitudinal precrease 36 and a left-hand side fold longitudinal precrease 37 as well as a right-hand front portion longitudinal precrease 38 and a left-hand front portion longitudinal precrease 39.

Figure 10:
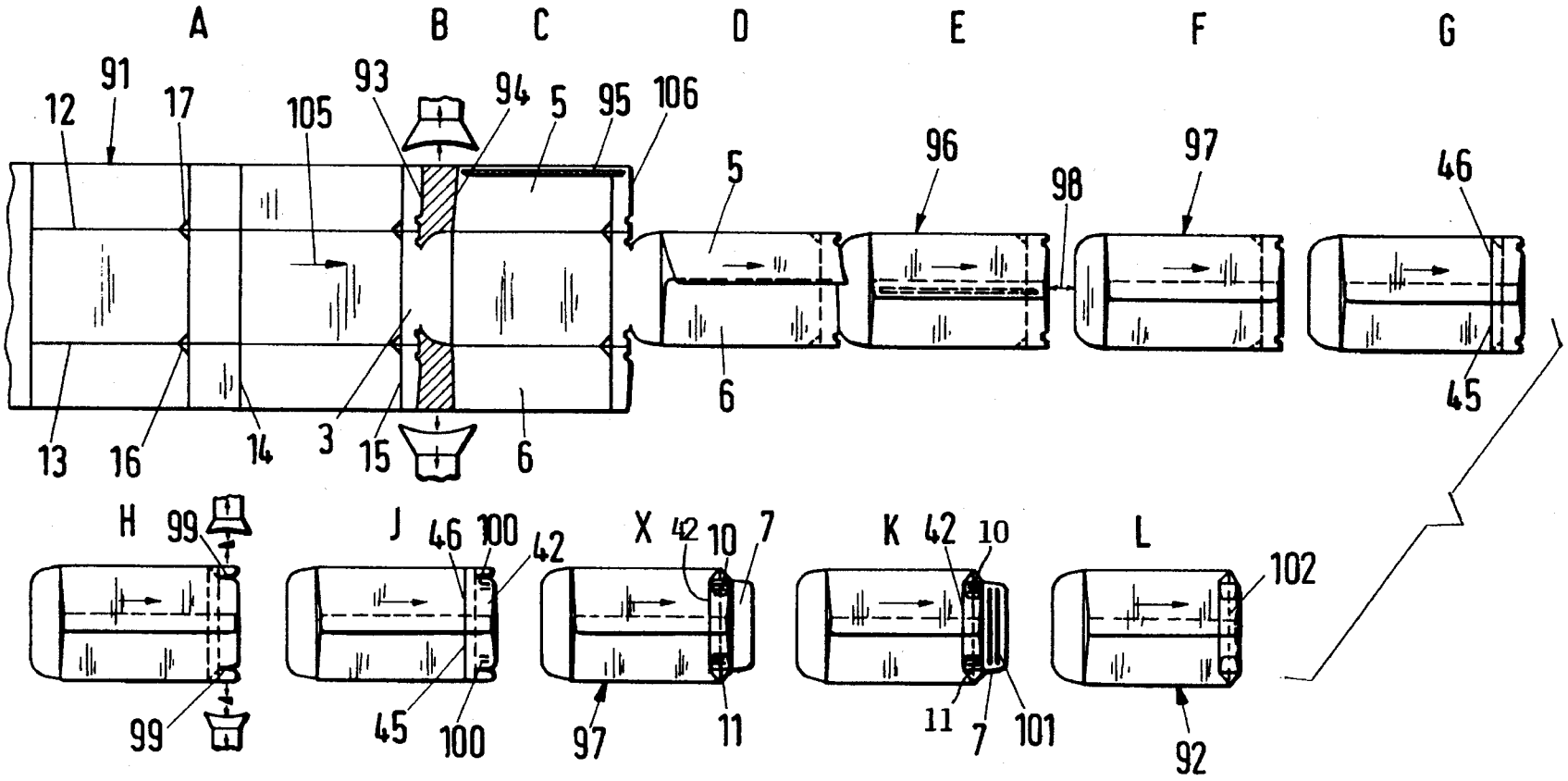
FIGS. 10 to 15 including

The bottom side tongues 10 and 11 are shaped in the cut blank 31 the same as in the cut blank 1. However, due to manufacturing, technical reasons, the bottom side tongues 10 and 11 facing the corners 40 of the bottom flap halves 8 and 9 according to FIG. 1 are not rounded. Rather, according to FIG. 3, cut-outs 41 formed by cuts 18, 19 are provided in these positions, whereby the bottom flap halves 43 and 44 and the bottom side tongues 10 and 11 can pass each other during the zig-zag motion more easily or without any problems (FIG. 10, see method steps H, I and K). The bottom flap halves 43 and 44 form the lower, or rather, the inwardly located second bottom flap 42.

The two cut blanks 1 and 31 further comprise bed bottom precreases 45 and 46 in the side flaps 5 and 6. These precreases 45 and 46 extend in a cut blank 31 for products with side folds at least to the side folds longitudinal precreases 36 and 37. Preferably, these precreases 45 and 46 are applied in separate method steps as is apparent from the description of the method.

Figure 4:
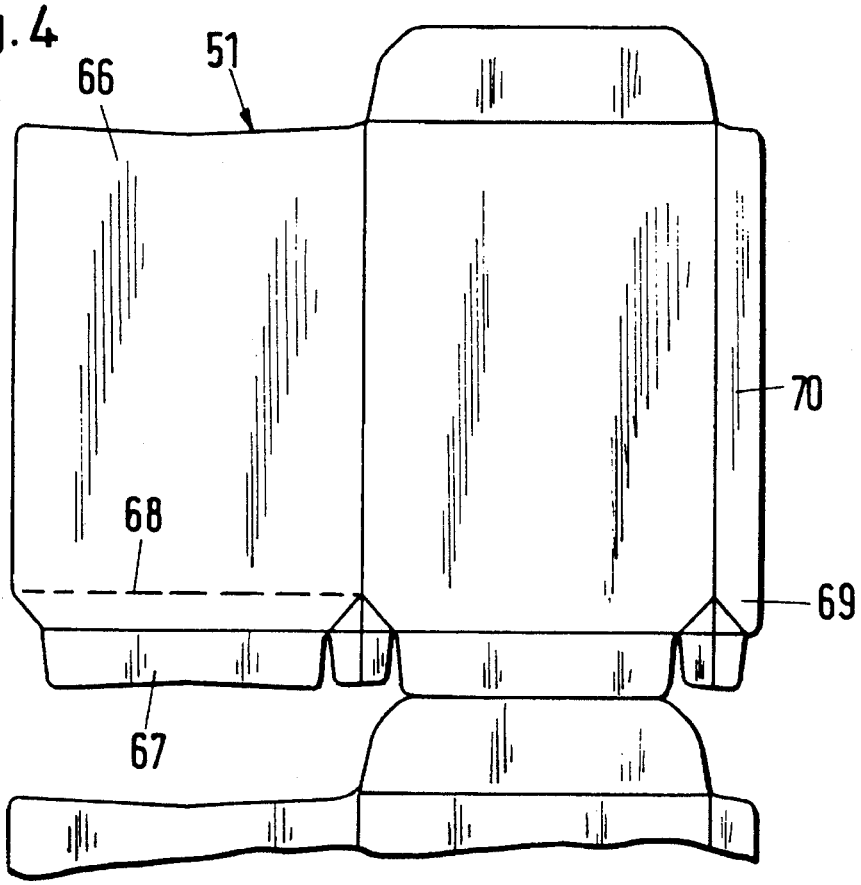
FIG. 4 is a developed view of a cut blank of a further product prior to separation into an individual blank.
Figure 5:
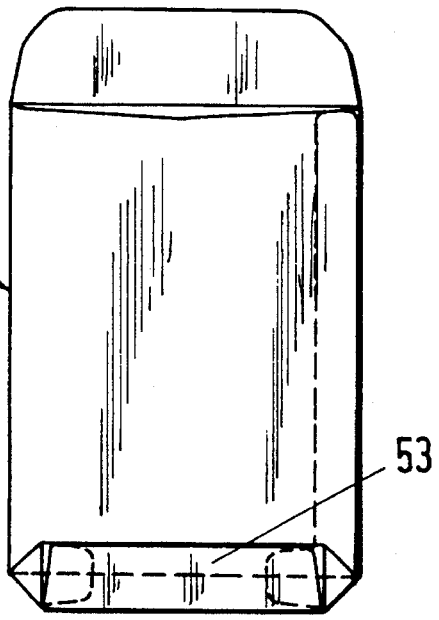
FIG. 5 is a view of the finished product according to FIG. 4.

FIG. 4 shows a cut blank 51 prior to separation into an individual blank, for a product 52 according to FIG. 5 without side folds, however with a bed bottom 53 and with side gumming.

Figure 6:
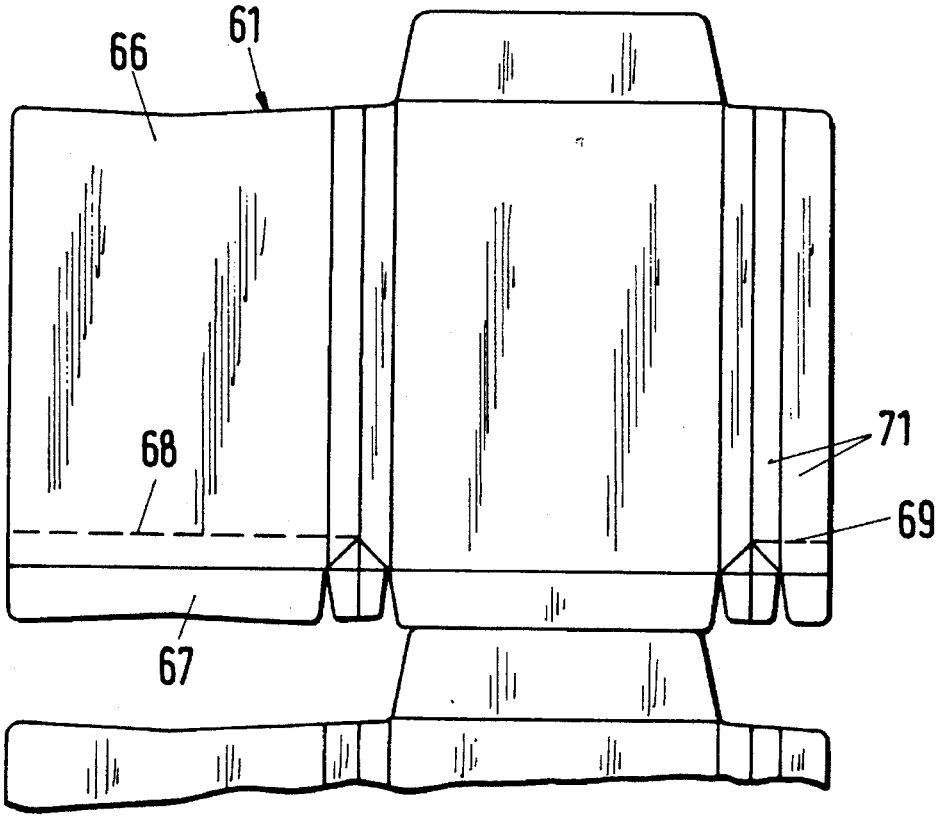
FIG. 6 is a developed view of a further product prior to the separation into an individual blank.
Figure 7:
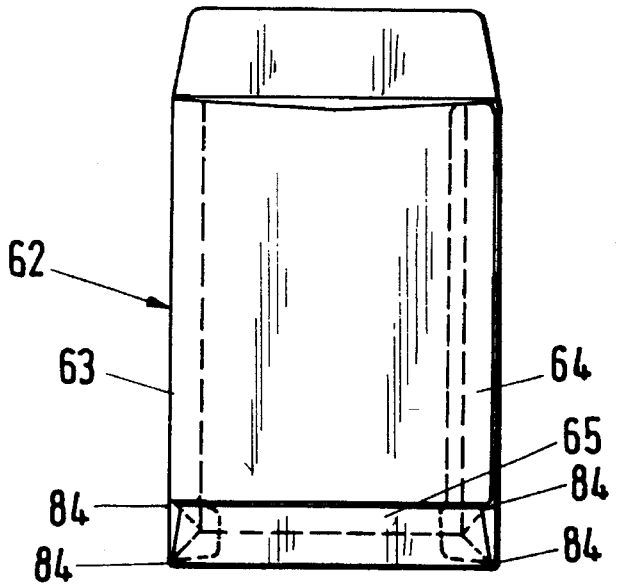
FIG. 7 is a view of the finished product according to FIG. 6.

FIG. 6 shows a cut blank 61 prior to separation into an individual blank for a product 62 according to FIG. 7 with side folds 63, 64 and with a bed bottom 65 with side gumming.

The cut blanks 1 and 31 according to FIGS. 1 and 3 relate to products having a central gumming as is the case for the product 22 according to FIG. 2.

The cut blanks 51 and 61 comprise instead of the side flaps, respectively a back portion 66 and a lower bottom flap 67. A bed bottom precrease 68 for the zig-zag fold is allocated to the bottom flap 67 in the same manner as the bed bottom precrease 69 is allocated to the side tongues 70 in the cut blank 51 or to the double side tongue 71 in the cut blank 61. The side tongue 70 serves for closing the product. In these instances the bed bottom precreases 68, 69 are also preferably introduced in a separate operation.

Figure 8:
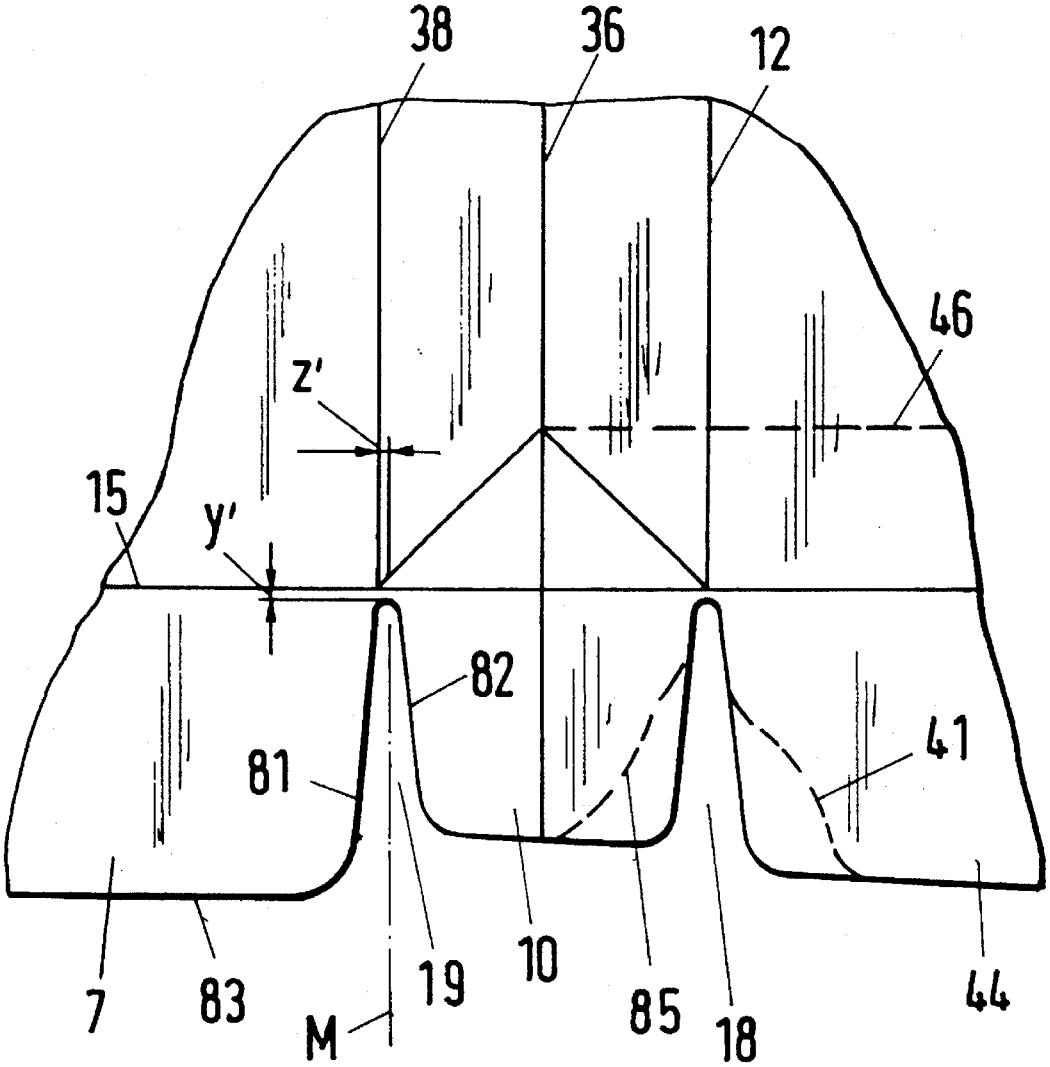
FIG. 8 shows, on an enlarged scale, a detail of the bottom zone of products having side folds.

In products having bed bottoms 65 and side folds 63, 64, it is practical that according to FIG. 8, the centerline M is displaced laterally by a measure Z' away from the front portion longitudinal precrease 38 or 39 and toward the side fold longitudinal precrease 36 or 37. The centerline M is located between the margin 81 next to the side tongue of the upper or first bottom flap 7 and the margin 82 next to the bottom flap of the neighboring bottom side tongue 10, 11. Further, the incisions 18 and 19 do not begin directly at the bottom flap cross precrease 15. Rather, the incisions are displaced by a measure Y' toward the free margin 83 of the bottom flap 7.

The foregoing achieves that the corners 84 (FIG. 7) of the bed bottom 65 are closed especially well.

Figure 9:
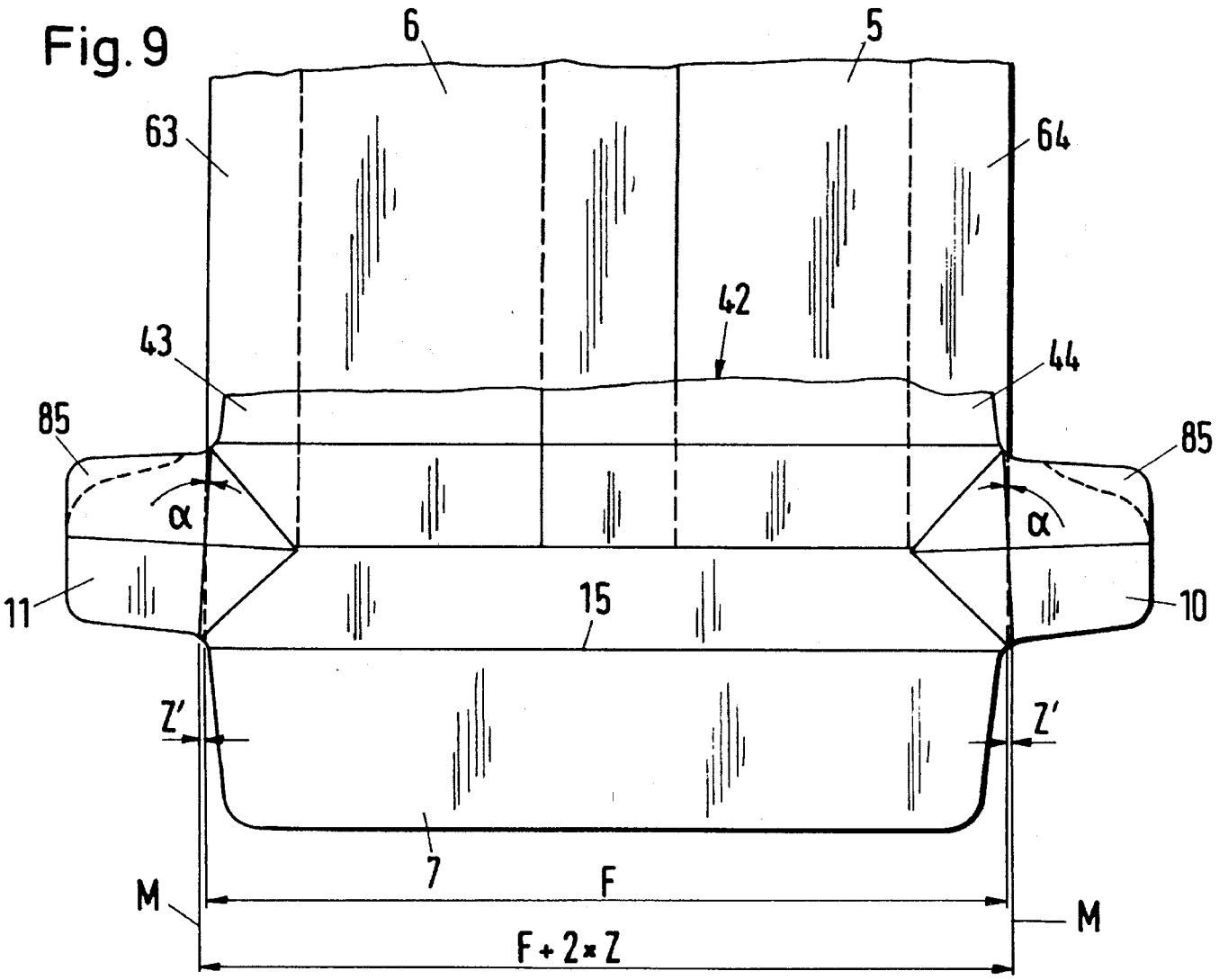
FIG. 9 is an illustration of the position that is assumed by the bottom side tongues of products having side folds, during the zig-zag fold formation.

In an embodiment according to FIG. 8, the bottom side tongues 10, 11 flip through an angle according to FIG. 9 when the zig-zag folding is performed. If the two center lines M next to the first bottom flap 7 are spaced from one another by a spacing corresponding to the format width F plus twice the displacement measure Z'.

The contour of the tongues 10, 11 and the contour of the bottom flap halves 8, 9 forming the second bottom flap 42 may correspond to the full lines or to the dashed lines in FIGS. 8 and 9. Thus, the flap halves may have a full contour or they may be provided with cut-outs 41 or 85. The measure Z' is variable as a function of the paper thickness, thereby depending on the paper thickness.

The manufacture of the products 22, 52, 62 takes place in accordance with the production methods illustrated in FIGS. 10 to 15 and these production methods are basically variable in their details. A web or strip material 92 serves as a starting material. The individual production steps are as follows for producing any desired products 92 without side folds as shown in FIG. 10:

Referring to FIG. 10, method step A involves the production of longitudinal precreases 12, 13 for the side flaps 5, 6 and the production of cross and angular precreases 14 to 17 in the strip or web material 91.

Method step B involves the production of lateral cuts 93, 94 for producing the side flaps 5, 6 and the closure flap 3, as well as the partial production of the two bottom flap halves 8, 9 and of the bottom side tongues 10, 11 and the removal of the waste.

Method step C involves the gumming or the application of an adhesive track 95 on the side flap 5.

Method step D involves the folding over of the side flaps 5, 6.

Method step E involves the closing and the manufacture of a tubular section 96 at the end 106 of the strip or web.

Method step F involves performing a severing cut for producing a tubular blank 97 and the production of a pull-out or rather a spacing 98 between the tubular section 96 still connected with the web or strip material 91 and the blank 97 already separated into an individual blank.

Method step G involves the production of the further cross-precrease 45, 46 to constitute a bed bottom precrease.

Method step H involves the production of bed bottom incisions 99 corresponding to the incisions or cuts 18 and 19 in the product first described above, for producing the bottom side tongues 10 and 11 and the first bottom flaps 7 and the second bottom flap 42 formed of the bottom flap halves 42.

Method step J involves the gumming or the application of adhesive tracks 100 on the second bottom flap 42 for the bonding with the bottom side tongues 10, 11.

Method step X involves pulling open the blank 97 in the area of the lower, uppermost position second bottom flap 42 as well as the zig-zag back displacing of the second bottom flap 42 to form a zig-zag fold about the cross-precreases 45, 46 serving as a bed bottom precrease. Step X also includes the inwardly directed folding over of the bottom side tongues 10, 11 onto the second bottom flap 42.

Method step K involves the gumming or the application of at least one adhesive track 101 on the first bottom flap 7. In the last step L the first bottom flap 7 is folded over onto the bottom side tongues 10 and 11, and onto the second bottom flap 42 for closing the bed bottom 102 to thereby finish the product 92, in which the bottom side tongues 10, 11 are positioned between the first bottom flap 7 and the second bottom flap 42 formed by the two bottom flap halves 8, 9 as shown in FIG. 2.

Figure 11:
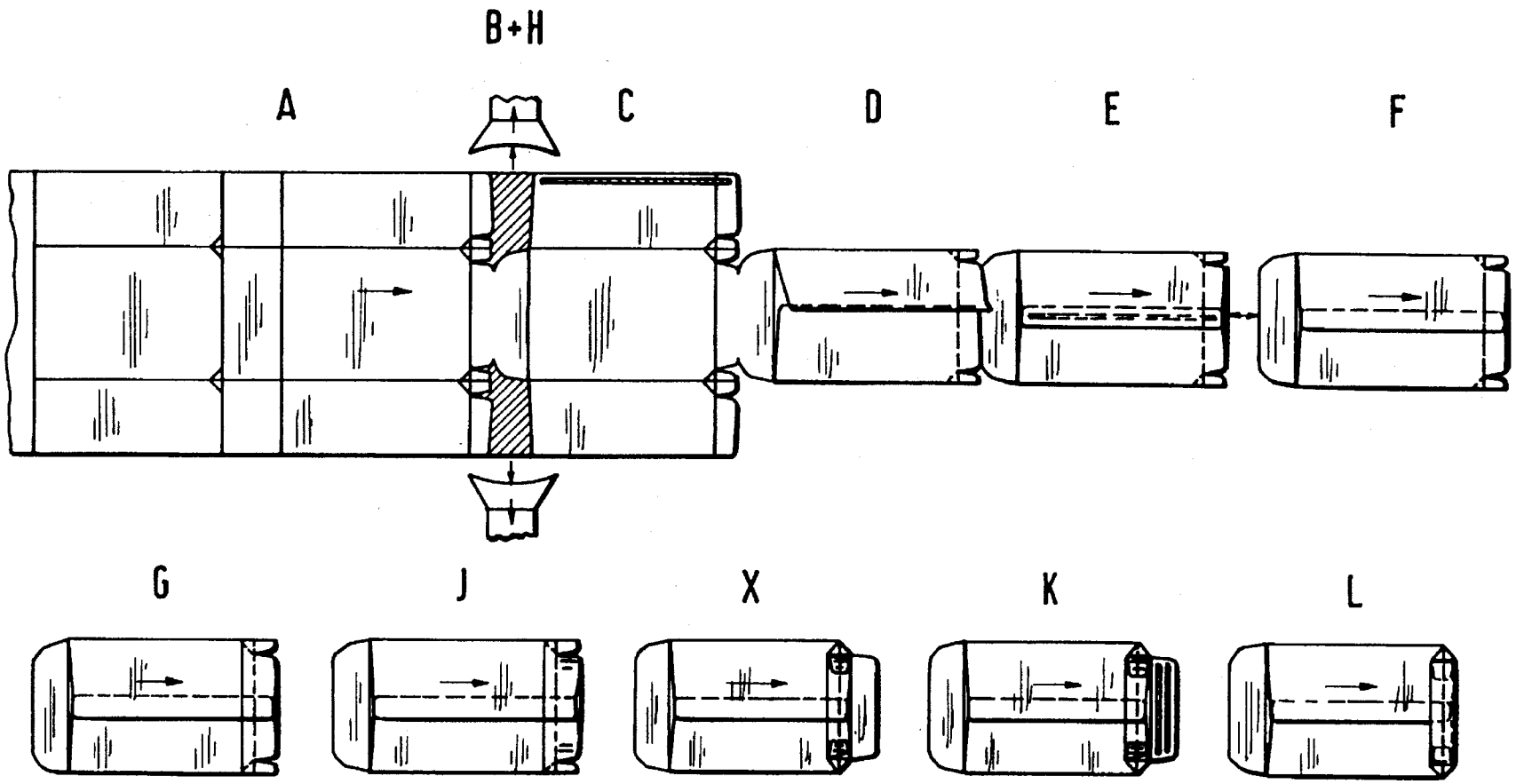

The method steps A to L may be modified, namely in such a way that the method step H takes place simultaneously with the method step B as is shown in FIG. 11.

Figure 12:
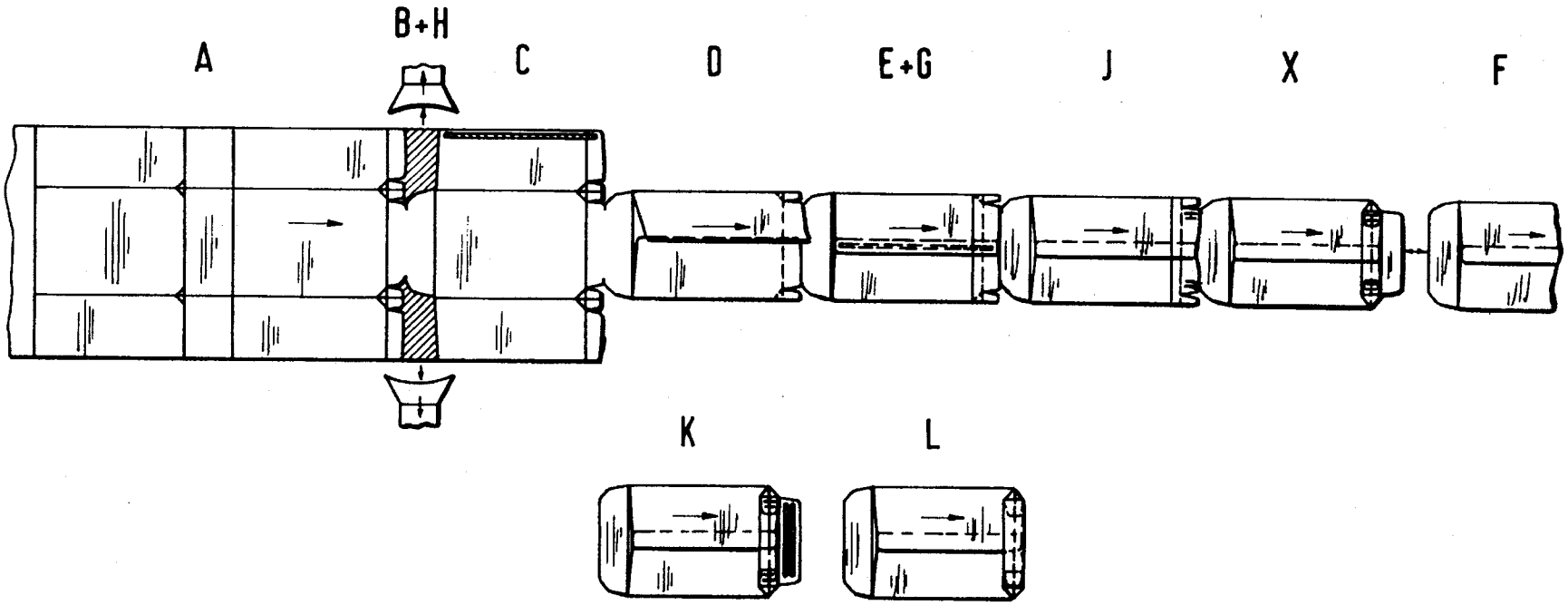
Figure 13:
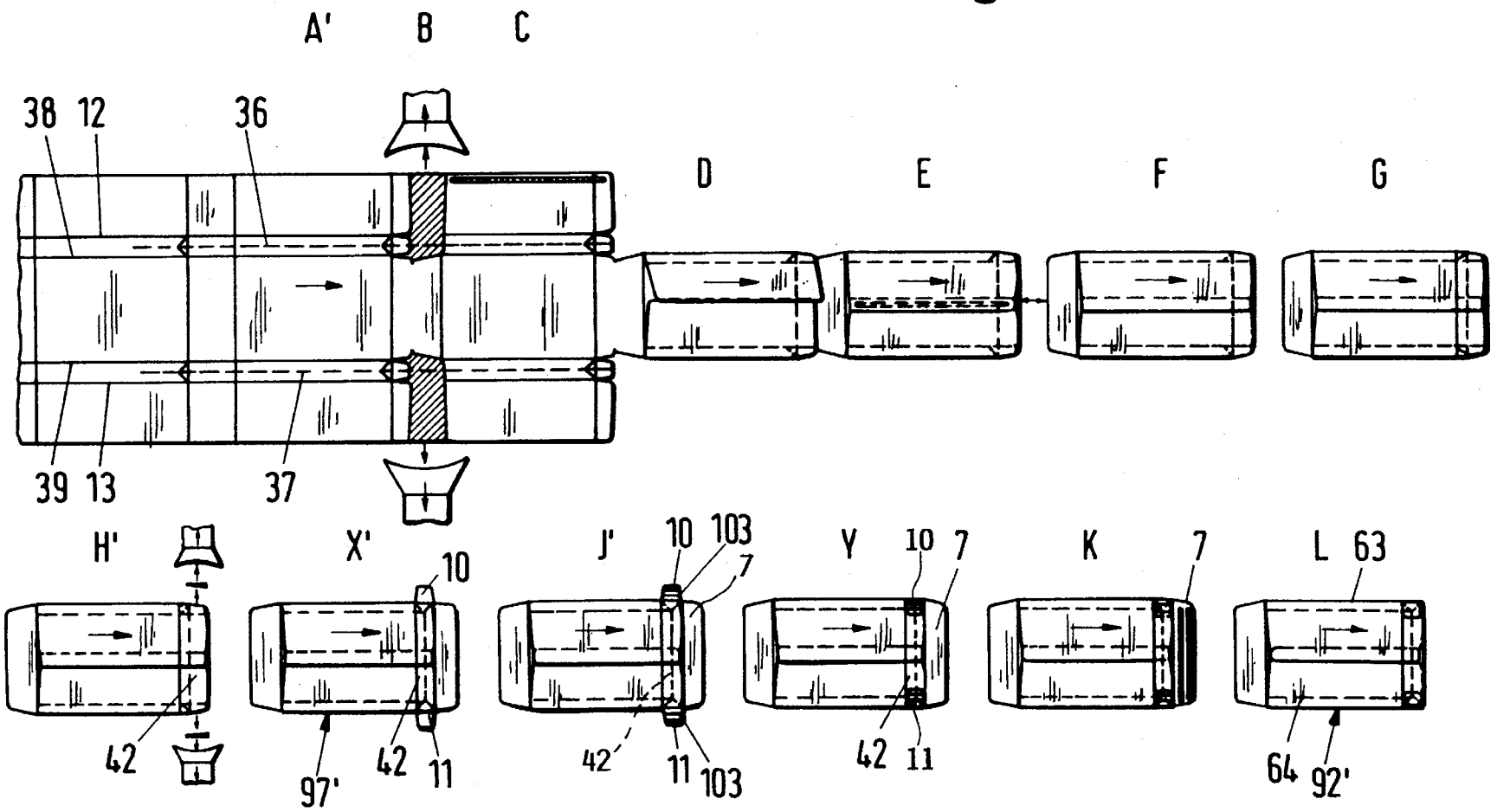

A further modification of the method steps A to L leads to the following sequence:

A; then B together with H; then the method steps C, D, E plus G, I, X, F, as well as K and L according to FIG. 12.

The method for manufacturing products 92' with side folds 63, 64, differs insignificantly from the method for making products 92 without side folds. Different modifications are also possible for the latter method as is apparent from FIGS. 13 to 15. The first method step A' is the same in all modifications. Method step A' comprises the production of inner or side flap longitudinal precreases 12, 13, and the front portion longitudinal precrease 38, 29 as well as the production of the outer or side fold longitudinal precreases 36, 37 for the side folds 63, 64, simultaneously with the production of cross- and angular-precreases 14 to 17 for the bottom flaps 7, 42, for the bottom side tongues 10, 11 and for the closure flap 3. Thereafter, the production steps B, C, D, E, F, G, H', X', I', Y as well as K and L are performed in the production method shown in FIG. 13.

The method steps B, C, D, E, F, and G, as well as K and L are identical to those in the methods described first. The steps H', X' and I' differ from the respective steps of the methods first described, and the step Y is an additional step that is not performed in the methods first described.

The method step H' involves a margin cut that passes through all material layers for producing the bottom tongues 10, 11.

The method step X' involves the pulling open of the blank 97' in the area of the second bottom flap 42 and the performing of a zig-zag folding involving a zig-zag shaped backward displacement of the second bottom flap 42 and the outwardly directed folding over of the bottom side tongues 10, 11.

During the method step I' the bottom side tongues 10, 11 are gummed or provided with adhesive tracks 103. During the method step Y the inwardly directed folding of the bottom side tongues 10, 11 on the second bottom flap 42 is performed. Thereafter, the first bottom flap 7 is provided with adhesive during method step K as before, and finally, during method step L the first bottom flap 7 is folded over and laid onto the bottom side tongues 10, 11 and onto the second bottom flap 42, whereby the side tongues 10, 11 are positioned between the first bottom flap 7 and the second bottom flap 42. Thus, the product 92' is completed.

Figure 14:
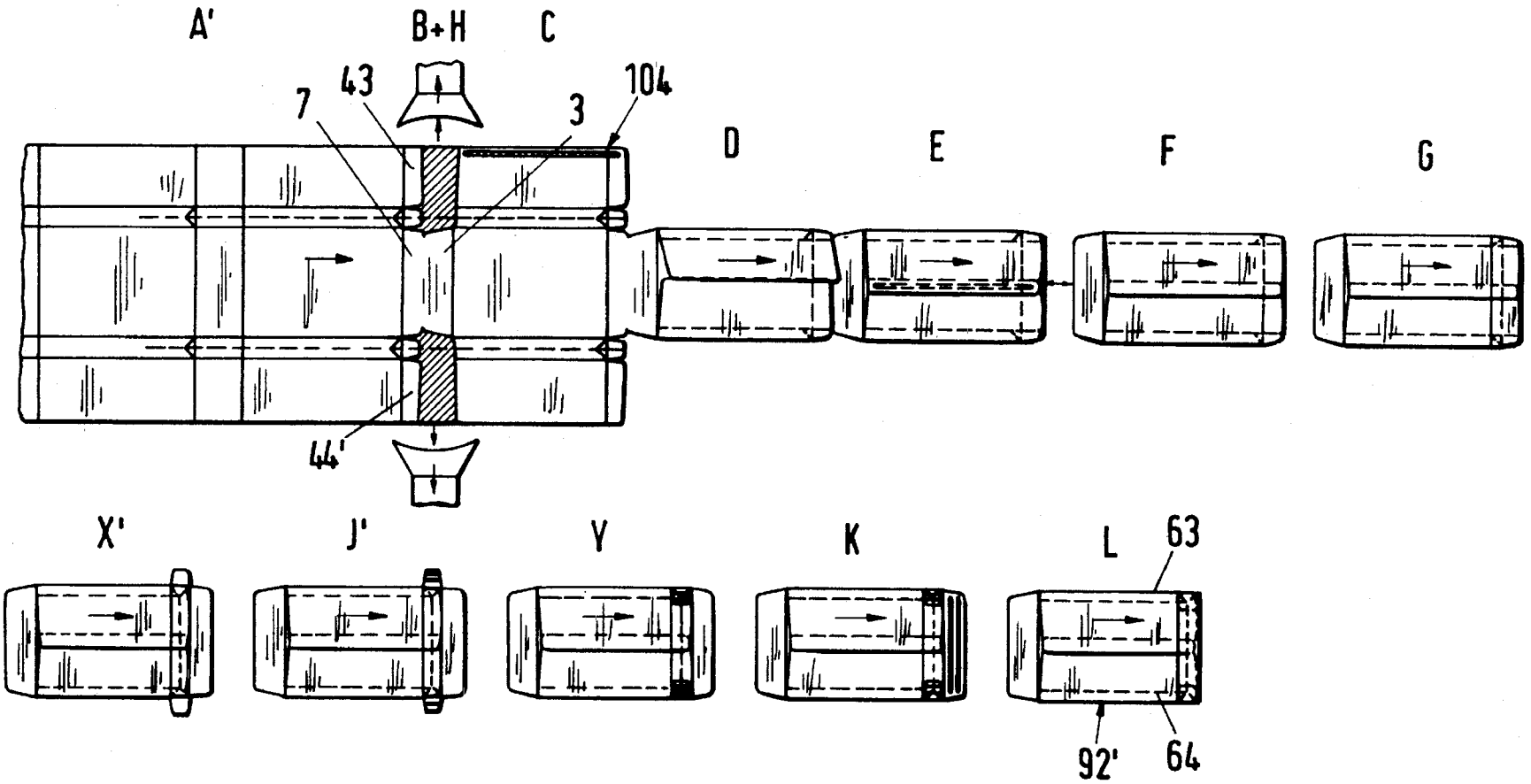
Figure 15:
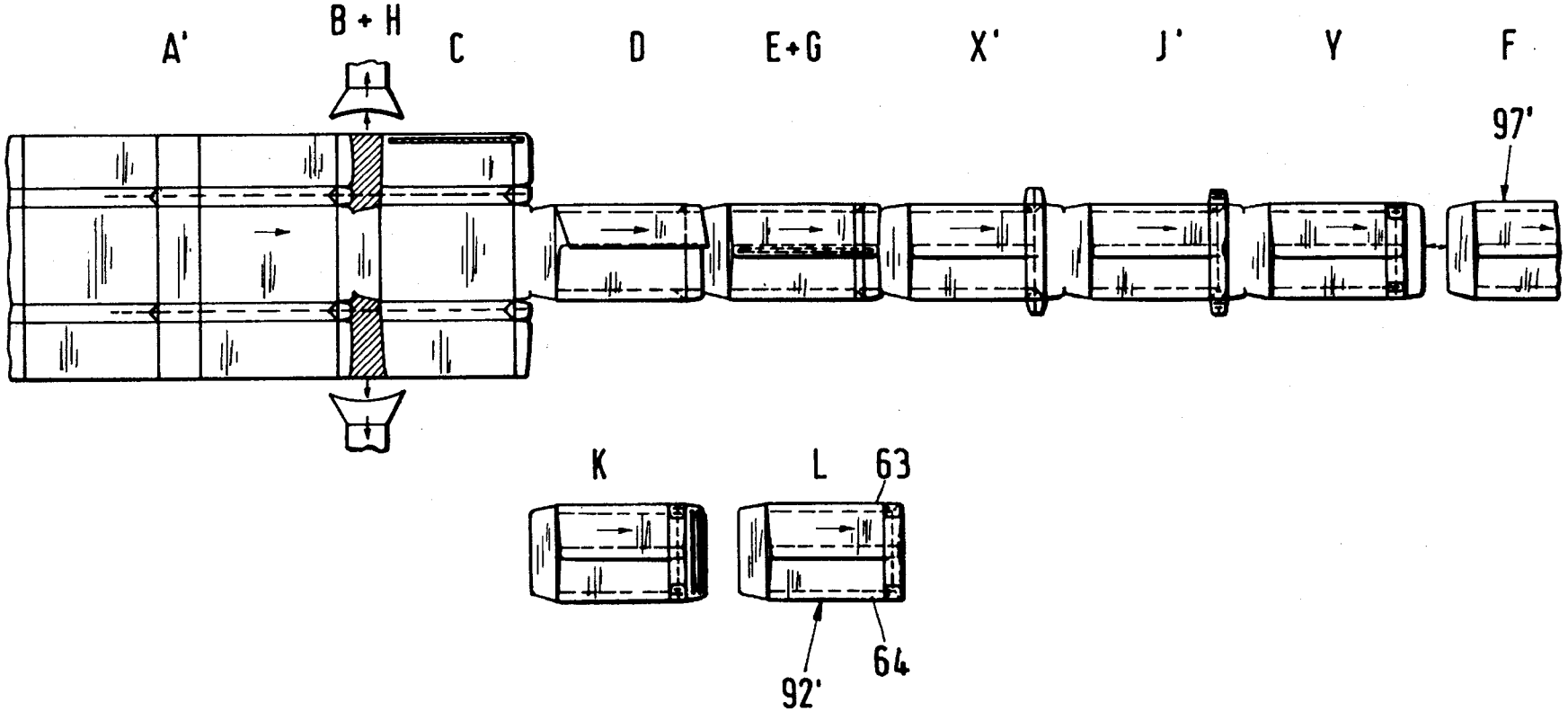

FIGS. 14 and 15 show modifications of this method. The method variation according to FIG. 14 combines the method steps B and H into one step so that now a single cut produces the bottom side tongues 10, 11, the bottom flap 42 comprising the two bottom flap halves 43, 44, and the upper bottom flap 7 together with a closure flap 3 of the portion 104 located forwardly as viewed in the transport direction. Thereafter, the method steps C, D, E, F, G, X', I', Y, as well as K and L are performed.

In the method variation according to FIG. 15, the steps B and H and the steps E and G respectively are combined into one method step. Further, the separation cut and the separating of the blank 97' into an individual blank according to method step F takes place only after the zig-zag step X' and the further sequence steps I' and Y. Step Y involves the inwardly folding over of the bottom side tongues 10, 11 onto the second bottom flap 42.

The examples show that a multitude of variations are possible and that the different method steps can be combined with one another so that it is possible to save stations in a machine that performs the method. In all instances, a manufacturing is involved that takes place with a continuous feed advance according to the arrows 105 in FIG. 10, whereby further the end 106 (FIG. 10) forming the bed bottom 102 respectively advances ahead in the transport direction.

Figure 16:
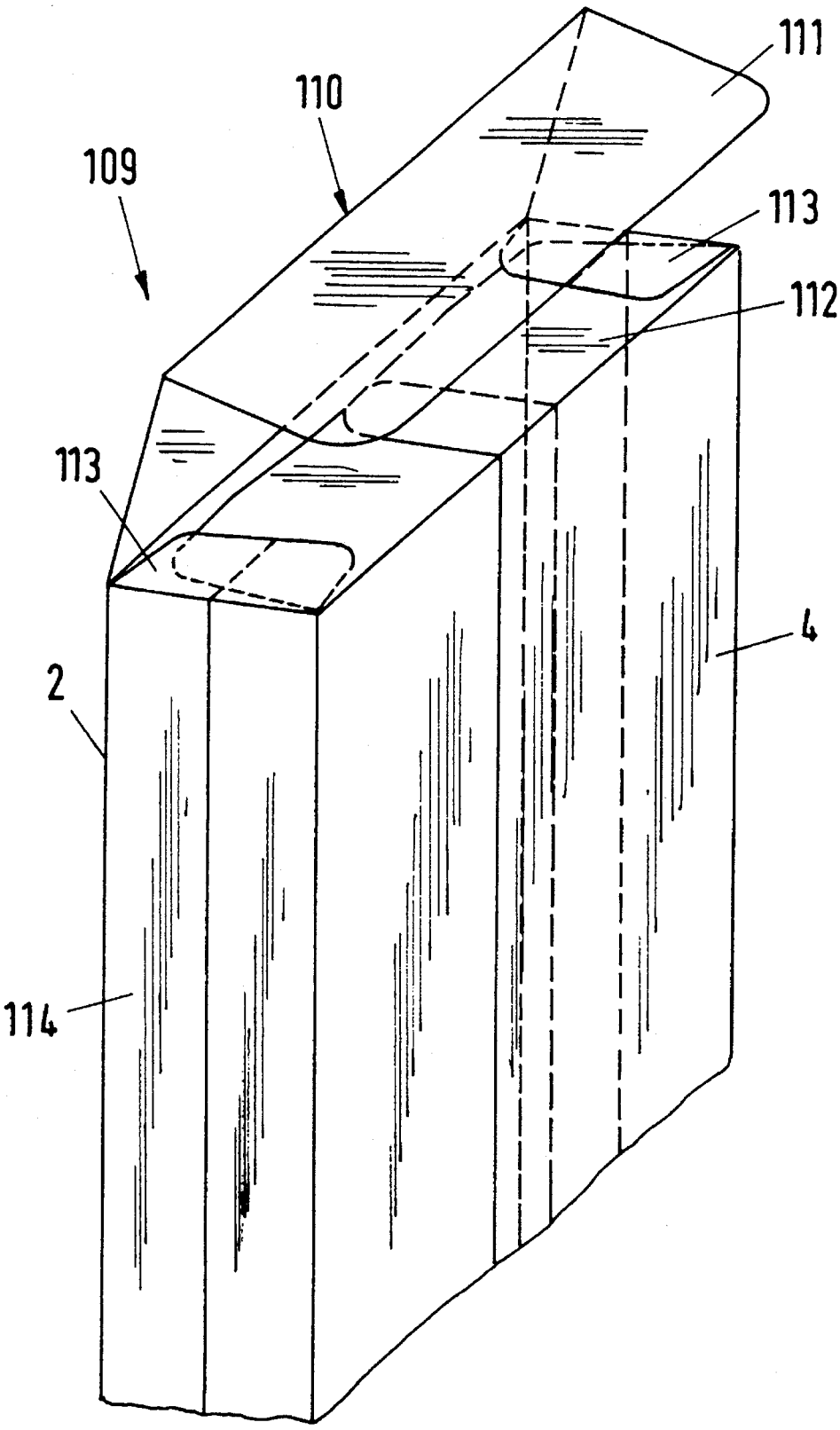
FIG. 16 is a cut-off, perspective illustration of a last, modified product.

The product 109 shown in FIG. 16 also indicates that the method according to the invention permits a multitude of modifications.

Thus, the product 109 shows a two piece closure flap 110 on the opening side of the front portion 2, including a closure tongue 111, while a back portion closure flap 112 is located on the back portion 4. Finally, closure tongues 113 are also provided on the side portions 114. Such a product 109 can be produced without difficulty by the method according to the invention, whereby merely the contour of the cut blank must be adapted.

Figure 10A:
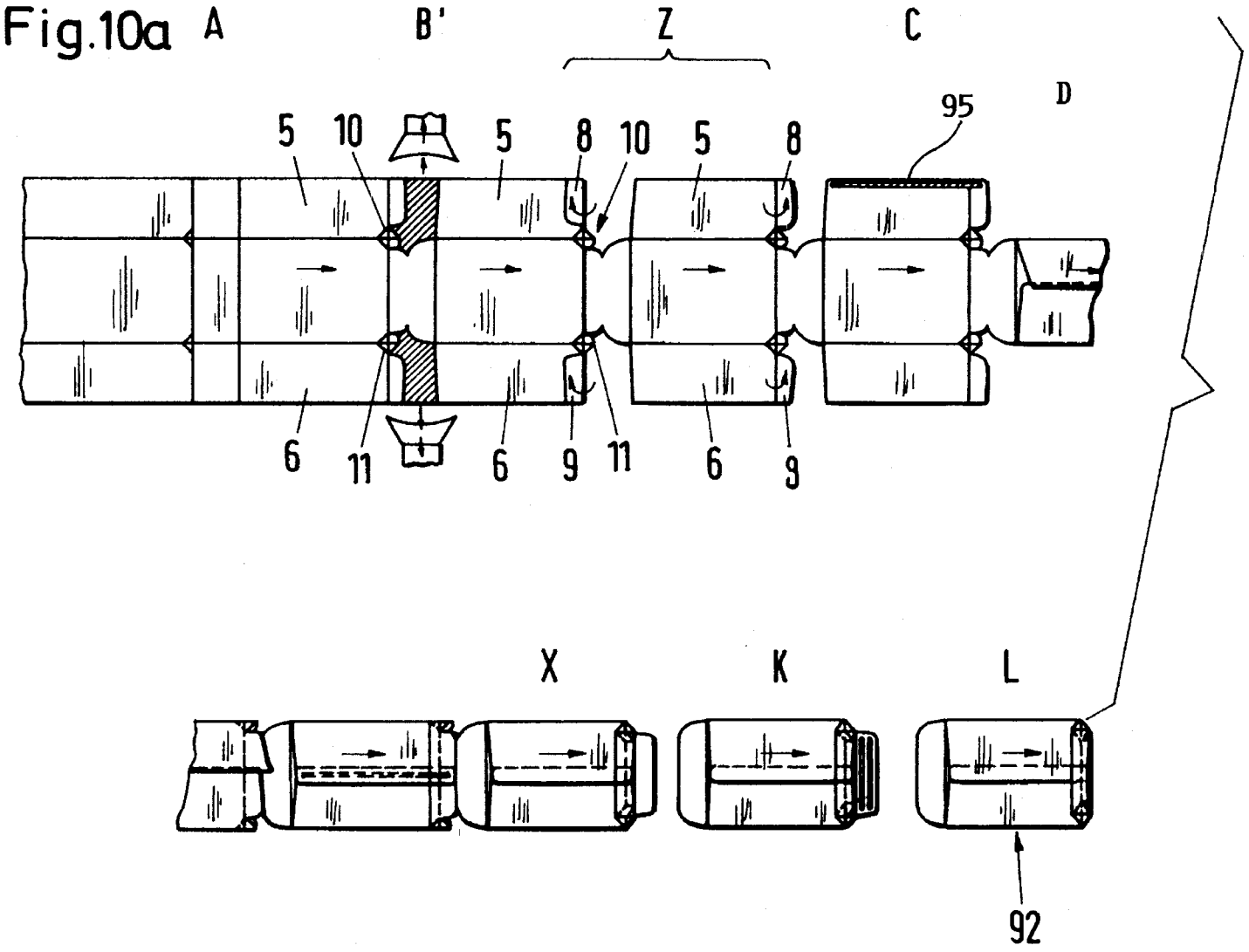
FIGS. 10*a* and 15*a*, are illustrations of the method steps and the respectively resulting blanks in a modification of the method.

The example embodiment shown in FIG. **10*a* combines the method steps B and H in the method step B', whereby the complete bottom side tongues 10 and 11 are produced. Further, at least one fold line that participates in the zig-zag fold is prefolded prior to the adhesive application on the side flap 5 (method step C in FIG. 10) or prior to the production of the zig-zag fold according to an additional method step Z (FIG. 10*a*), whereby the prefolding takes place in a direction opposite to the zig-zag fold at least once back and forth. According to this example embodiment, the back and forth fold takes place suitably on the web 91. For this purpose, the two bottom flap halves 8, 9 or 43, 44 are first folded about their bed bottom precreases 45, 46 onto the side flaps 5, 6, and then tilted back again. This is indicated in FIG. 10*a*** with the method step Z with the aid of small arrows.

Figure 15A:
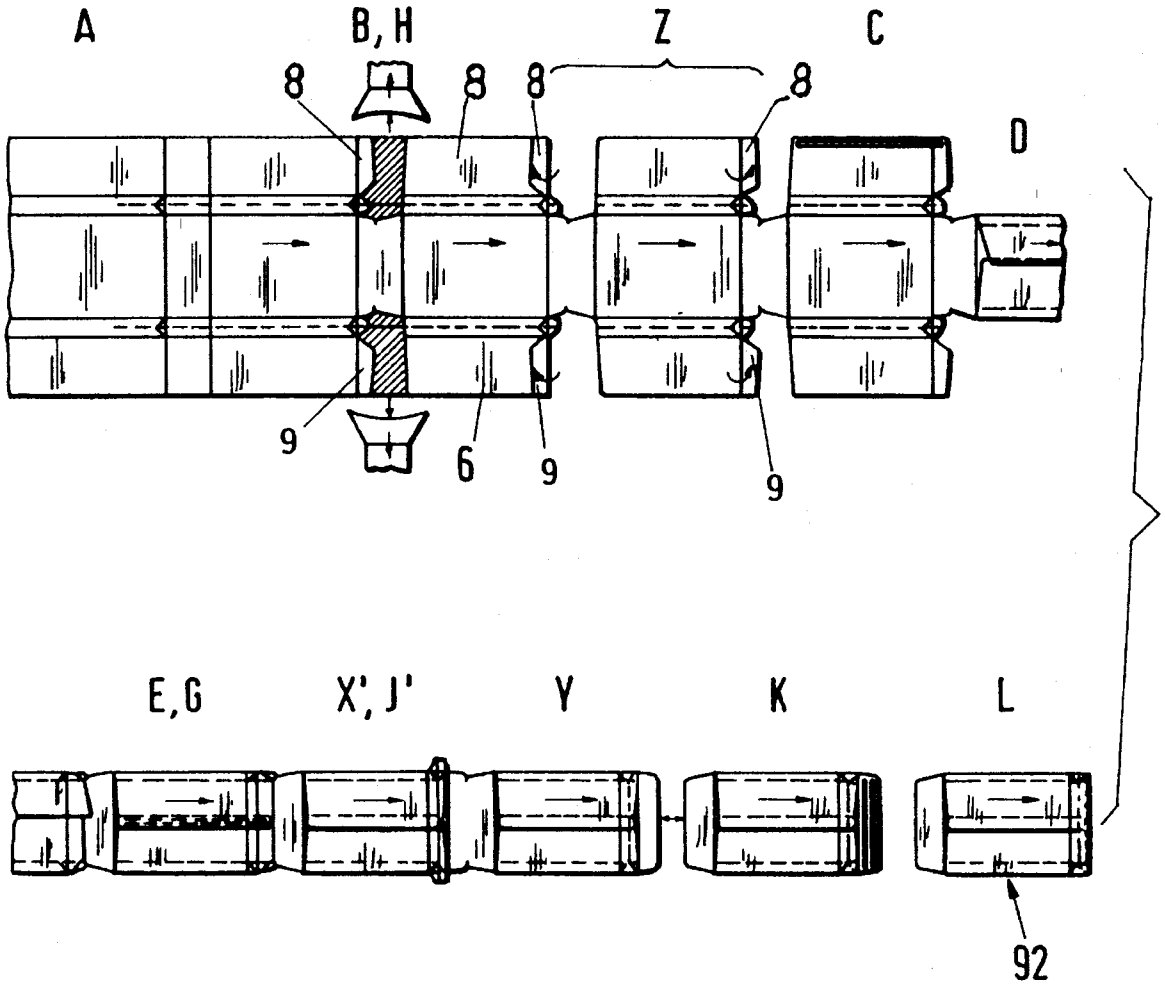

Whereas FIG. **10*a* shows the method steps for the manufacture of a product without side folds, FIG. 15*a* relates to the additional method step Z for manufacturing a product with side folds. In this instance, the bottom flap halves 43, 44 are also merely folded onto the side flaps 5, 6, whereupon they are tilted back again in order to make the bed bottom precreases 45, 46** pliant for the zig-zag fold taking place subsequently (method step XY).

It is a feature that the additional use of the method step Z is possible for all other example embodiments.

Although the invention has been described with reference to specific example embodiments, it will be appreciated that it is intended to cover all modifications and equivalents within the scope of the appended claims.

I claim:

1. A method for the continuous manufacture of a packing enclosure made of sheet material, said packing enclosure including an area with gumming for closing the enclosure, a respective folded and glued flat bed bottom, and front and back sides, wherein the sheet material is continuously advanced in a forward feed advance direction and first precreased, cut, gummed, and folded and closed lengthwise for forming a tubular blank, comprising the following additional steps:

(a) forming main bottom cross-precreases (15, 45, 46), (b) making incisions for forming two bottom side tongues (10, 11), a first bottom flap (7) and two bottom flap halves (8, 9; 43, 44) for forming a second bottom flap

(42) by making a double cut (18, 19) in the sheet material for each of said bottom side tongues (10, 11), one cut (19) of each double cut extending between the respective side tongue (10, 11) and said first bottom flap (7), the other cut (18) of each double cut extending between the respective side tongue (10, 11) and one of said bottom flap halves (8, 9) forming the second bottom flap (42), (c) folding said second bottom flap (42) backwardly opposite to said forward feed advance direction and then forward again to form a full zig-zag fold about said main bottom cross-precreases (15, 45, 46) for forming said flat bed bottom, said double cuts of said side tongues permitting said backward folding of said second bottom flap (42) without interference between said bottom flap halves (8, 9) forming said second bottom flap (42) and said bottom side tongues (10, 11), (d) providing adhesive for gluing said bottom side tongues (10, 11) to said first and second bottom flaps (7, 42), and (e) folding said bottom side tongues (10, 11) onto said second bottom flap (42) and folding said first bottom flap (7) onto said bottom side tongues (10, 11) and against said second bottom flap (42) laterally between said bottom side tongues (10, 11), to close said flat bed bottom, whereby said bottom side tongues (10, 11) are glued-in between the first-and second bottom flaps (7, 42).

2. The method of claim 1, comprising moving said tubular blank so that a portion of said sheet material for forming said flat bed bottom, is leading forward in said feed advance direction.

3. The method of claim 1, further comprising performing a pulling open and said backward moving of said second bottom flap (42) forming said full zig-zag fold on a severed blank (97, 97').

4. The method of claim 3, wherein said pulling open and said backward moving of said full zig-zag fold of said second bottom flap (42) is performed on said sheet material of said tubular blank prior to performing a severing cut for separating said tubular blank from said sheet material and prior to a separation of said tubular blank.

5. The method of claim 1, further comprising causing said bottom side tongues (10, 11) to lay themselves laterally outwardly for forming side folds in said packing enclosure.

6. The method of claim 1, further comprising causing said bottom side tongues (10, 11) to lay themselves over inwardly to avoid the formation of side folds.

7. A method for the continuous manufacture of a packing enclosure made of a sheet material, said packing enclosure including an area with gumming for closing the enclosure and a respective folded and glued flat bed bottom (102), comprising the following steps:

(A) producing longitudinal precreases (12, 13) for forming back flaps (5, 6) and producing cross- and angular-precreases (14, 15, 16, 17) in the sheet material (91) for forming bottom flaps (7, 42), for forming bottom side tongues (10, 11), and for forming a closure flap (3);

(B) producing lateral cuts (93, 94) for forming said back flaps (5, 6) and said closure flap (3), and for the partial production of said bottom flaps (7, 42), and of said bottom side tongues (10, 11);

(C) gumming one back flap (5);

(D) folding over of the back flaps (5, 6);

(E) gluing said back flaps together so that a tubular section (96) is formed having an end (106) facing in a forward direction;

(F) cutting said tubular section off to form a severed tubular blank (97) and producing a spacing (98) between a tubular section still connected with said sheet material (91) and said severed tubular blank (97);

(G) producing further cross-precreases (45, 46) as a bed bottom precrease on said severed tubular blank;

(H) making bed bottom incisions (99) in said forward end (106) for forming said bottom side tongues (10, 11) and said bottom flaps (7, 42);

(I) applying adhesive on one of said bottom flaps for securing bottom side tongues (10, 11) to said one of said bottom flaps;

(X) pulling open said severed tubular blank (97) in the area of said one of said bottom flaps and backwardly folding said one of said bottom flaps relative to a forward feed advance direction of said sheet material and folding said one of said bottom flaps forward again for forming a full zig-zag fold about said first mentioned cross-precrease (15) and said further cross-precreases (45, 46), and inwardly folding over of said bottom side tongues (10, 11);

(K) gumming of the other one of said bottom flaps; and (L) folding over said other one of said bottom flaps onto said bottom side tongues (10, 11) so that said bottom side tongues (10, 11) are glued in place between said bottom flaps (7, 42) and thereby closing said flat bed bottom.

8. The method of claim 7, wherein said step (H) is performed simultaneously with said step (B).

9. The method of claim 7, wherein said steps are performed in the following sequence: (A); then (B) together with (H); then steps (C), (D), (E) together with (G), (I), (X), (F), as well as (K) and (L).

10. The method of claim 7, comprising performing a further step (Z) by making at least one fold line or precrease which participates in said full zig-zag fold, and prefolding said zig-zag fold at least once forward and backward prior to forming said full zig-zag fold according to method step (X) in a direction opposite to a feed advance direction.

11. The method of claim 10, further comprising forming two bottom flap halves (8, 9) and prefolding said two bottom flap halves (8, 9) at least once back and forth around their bed bottom precreases (45, 46) on the side flaps (5, 6).

12. The method of claim 7, modified for making a shipping enclosure with side folds (63, 64), further comprising additional step (A') including forming side flap longitudinal precreases (12, 13) and front portion longitudinal precreases (38, 39) for side flaps (5, 6), forming fold longitudinal precreases (36, 37) for side folds (63, 64), and simultaneously producing cross- and angular-precreases (14 to 17) for bottom flaps (7, 42), for bottom side tongues (10, 11), and for a closure flap (3), a step (H') including making a margin cut that passes through all material layers, a step (X') including pulling open of a blank (97') in one of said bottom flaps forming a lower bottom flap (42) and backwardly displacing said one bottom flap in a zig-zag backward displacement to form a zig-zag fold, and outwardly folding over of the bottom side tongues (10, 11), a step (I') including gumming of the bottom side tongues (10, 11), and a step (Y) including inwardly folding over said bottom side tongues (10, 11) onto said lower bottom flap (42), and performing said additional steps in the following sequence (A'), (B), (C), (D), (E), (F), (G), (H'), (X'), (I'), (Y), (K), and (L).

13. The method of claim 12, with the following sequence modification: step (A'); then (B) together with (H); then (C), (D), (E), (F), (G), (X'), (I'), (Y), (K) and (L).

14. The method of claim 12, with the following sequence modification: step (A'); then (B) together with (H); then (D), then (E) together with (G), (X'), (I'), (Y), (F), (K) and finally (L).

* * * * *